US009364945B1

(12) United States Patent
Lander

(10) Patent No.: US 9,364,945 B1
(45) Date of Patent: Jun. 14, 2016

(54) COMBINATION PRESS AND PULLER TOOL

(76) Inventor: Erik William Lander, Sutter Creek, CA (US)

( * ) Notice: Subject to any disclaimer, the term of this patent is extended or adjusted under 35 U.S.C. 154(b) by 1071 days.

(21) Appl. No.: 13/506,317

(22) Filed: Apr. 10, 2012

Related U.S. Application Data

(60) Provisional application No. 61/517,052, filed on Apr. 11, 2011.

(51) Int. Cl.
*B25B 27/06* (2006.01)
*B25B 27/02* (2006.01)

(52) U.S. Cl.
CPC ..... *B25B 27/06* (2013.01); *B25B 27/02* (2013.01); *B25B 27/062* (2013.01)

(58) Field of Classification Search
CPC ..... B25B 27/06; B25B 27/02; B25B 27/062; Y10T 403/7182; Y10T 403/7188; Y10T 403/7194
USPC ..... 29/263, 259, 244, 281.1, 281.5
See application file for complete search history.

(56) References Cited

U.S. PATENT DOCUMENTS 1,478,648 A * 12/1923 Grahek ..... 29/259
1,608,407 A * 11/1926 Macias ..... 29/263
2,267,662 A 12/1941 Miller
2,387,839 A 10/1945 Frost
2,677,174 A * 5/1954 Lee ..... B25B 27/00 29/259
2,742,853 A 4/1956 Knelson
2,781,015 A * 2/1957 Dehn et al. ..... 72/451
3,283,699 A 11/1966 Hawkins
3,307,830 A 3/1967 Van Allen
3,389,653 A * 6/1968 Hany ..... 100/214
3,688,381 A * 9/1972 Shiflet ..... B23P 19/02 29/263
3,883,941 A * 5/1975 Coil ..... B23P 19/025 29/259
3,908,258 A 9/1975 Barty
3,972,103 A * 8/1976 Kenyon ..... B25B 27/0035 29/263
3,997,960 A * 12/1976 Kenyon ..... 29/263
4,989,312 A * 2/1991 Maddalena ..... B25B 27/023 29/259
5,839,180 A * 11/1998 Hochmiller ..... B25B 27/026 29/252
5,906,155 A 5/1999 Hammond
6,266,861 B1 7/2001 Chen
6,601,277 B1 * 8/2003 Swanson ..... B25B 27/023 29/256
6,823,574 B2 * 11/2004 Swanson ..... B25B 27/023 29/264

* cited by examiner

*Primary Examiner* — Monica Carter
*Assistant Examiner* — Mahdi H Nejad

(57) ABSTRACT

One embodiment of a modular combination press and puller tool consisting of a tool body (4) comprising a tubular element open at both ends and with a plurality of elongated fins radially displaced on the outer surface of the tubular element, with the long axis of the fins parallel to the longitudinal axis of the tubular element, the fins having a plurality of apertures, and one end of the tubular element at least partially threaded (16) on the internal diameter.

4 Claims, 15 Drawing Sheets

COMBINATION PRESS AND PULLER TOOL

CROSS-REFERENCE TO RELATED APPLICATIONS

This application claims the benefit of provisional patent application Ser. No. 61/517,052, filed 2011 Apr. 11 by the present inventor.

BACKGROUND

Prior Art

The following is a tabulation of some prior art that presently appears relevant:

| Pat. No. | Kind Code | Issue Date | Patentee |
|---|---|---|---|
| 2,267,662 | B1 | Dec. 23, 1941 | Miller |
| 2,387,839 | B1 | Oct. 30, 1945 | Frost |
| 2,742,853 | B1 | Apr. 24, 1956 | Knelson |
| 3,283,699 | B1 | Nov. 8, 1966 | Hawkins |
| 3,307,830 | B1 | Mar. 7, 1967 | Van Allen |
| 3,908,258 | B1 | Sep. 30, 1975 | Barty |
| 5,906,155 | B1 | May 25, 1999 | Hammond |
| 6,266,861 | B2 | Jul. 31, 2001 | Chen |

Hydraulic presses and pullers are important tools in many industries. They are used to assemble and disassemble components that are frictionally fitted to each other, and are often used to bend and or plastically deform metallic and non-metallic workpieces. A number of different designs of press frames and power sources have been employed in the prior art, but the functional differences are minor. The frames of conventional presses are classified as either "H-frames" or "C-frames" because they resemble the letters C or H. U.S. Pat. No. 2,267,662 to Miller (1941), 2387839 to Frost (1945), 2742853 to Knelson (1956), and 3283699 to Hawkins (1966) are examples of H-frames, while U.S. Pat. No. 5,906,155 to Hammond (1999) is an example of a C-frame press.

U.S. Pat. No. 3,283,699 to Hawkins is typical of the conventional H-frame presses that are commercially available. It uses a hydraulic jack as a power source and a pressing pin that are constrained by guide pins to move only in the vertical axis. The pressing pin or other work engaging tools employed must only apply force in the direction of the axis of the pin, offset loading may bend the pin and poses a danger of forcibly ejecting the workpiece from the press.

Their frames must be sized to accommodate the largest workpieces anticipated, thus the frame is more costly and bulky than necessary. The position of the hydraulic jack and pressing pin are fixed in relation to the frame members, this lack of lateral adjustability often interferes with optimal orientation of the workpiece in the press. The presses described above are dedicated in their functionality, they cannot be configured as standalone or portable pullers.

U.S. Pat. No. 3,307,830 to Van Allen (1967) addresses some of the above cited disadvantages and can be configured as either a press or a puller. It has a hydraulic cylinder that can be displaced laterally within the press frame, and the hydraulic pump is separate from the hydraulic cylinder. Van Allen also describes a press frame whose dimensions can be varied, but it is a complex design and thus overly expensive to manufacture. It is essentially two separate H-frames that are joined by bridging members. Van Allen's patent suggests that when configured as a puller the hydraulic cylinder and the crosshead mounted to the end cap of the cylinder be dismounted from the press frame and used as the basis of the puller. In practice this is a disadvantage because the crosshead as used in the press is in most cases much larger than desired in the puller configuration, necessitating the purchase of multiple sizes of crosshead

SUMMARY

In accordance with one embodiment a modular combination press and puller comprising a tubular element open at both ends and with a plurality of elongated fins radially displaced on the outer surface of the tubular element, with the long axis of the fins parallel to the longitudinal axis of the tubular element, and one end of the tubular element at least partially threaded on the internal and or external diameter. The tubular element optionally containing at least one elongated aperture communicating between its exterior and interior surfaces.

Advantages

Accordingly several advantages of one or more aspects are as follows: a tool that can be readily configured to perform many different pressing, bending, and pulling operations, that can be operated with or without attachment to a separate frame or support structure, that is portable and can be held in the hand during operation, that provides a simple and versatile means of attaching to any form of press frame or other structure, that can attach a hydraulic cylinder to the tool in multiple orientations, that can resist very large lateral bending moments applied to a displaceable ram, that is particularly adaptable to the attachment of any type of work engaging arms and other appliances. Other advantages of one or more aspects will be apparent from a consideration of the drawings and ensuing description.

DRAWINGS

Figures

Drawings - List of Reference Numerals

| | | | |
|---|---|---|---|
| 2 | Hydraulic cylinder | 4 | Tool body |
| 5 | Aperture | 6 | Guided ram extension |
| 7 | Aperture | 8 | Bolt |
| 10 | Nosepiece | 12 | Spring plunger |
| 14 | Hydraulic cylinder ram | 16 | Internally threaded aperture |
| 18 | Additional embodiment of tool body | 20 | Cylinder adapter for Additional embodiment of tool body |
| 22 | Threaded nosepiece | 24 | Pin |
| 26 | Pin | 28 | Tool body adapter |
| 30 | Coupling pin | 34 | Base |
| 36 | Coupling | 38 | Reaction block |
| 40 | Housing | 42 | Step block |
| 44 | Axle | 46 | H - frame adapter |
| 48 | Base plate | 50 | Side plate |
| 52 | Mounting flange | 54 | Block |
| 56 | Aperture | 58 | H - frame member |
| 60 | Elongated aperture | 62 | Aperture |
| 64 | Mechanical ram | 66 | Housing |
| 68 | Threaded sleeve | 70 | Retainer |
| 72 | Bearing | 74 | Bearing |
| 76 | Eccentric | 78 | Shaft |
| 80 | Connecting rod | 82 | Aperture |
| 84 | Pin | 86 | Crosshead |
| 88 | Internal thread | | |

DETAILED DESCRIPTION

FIGS. 1-4, 6-17

First Embodiment

Figure 1:
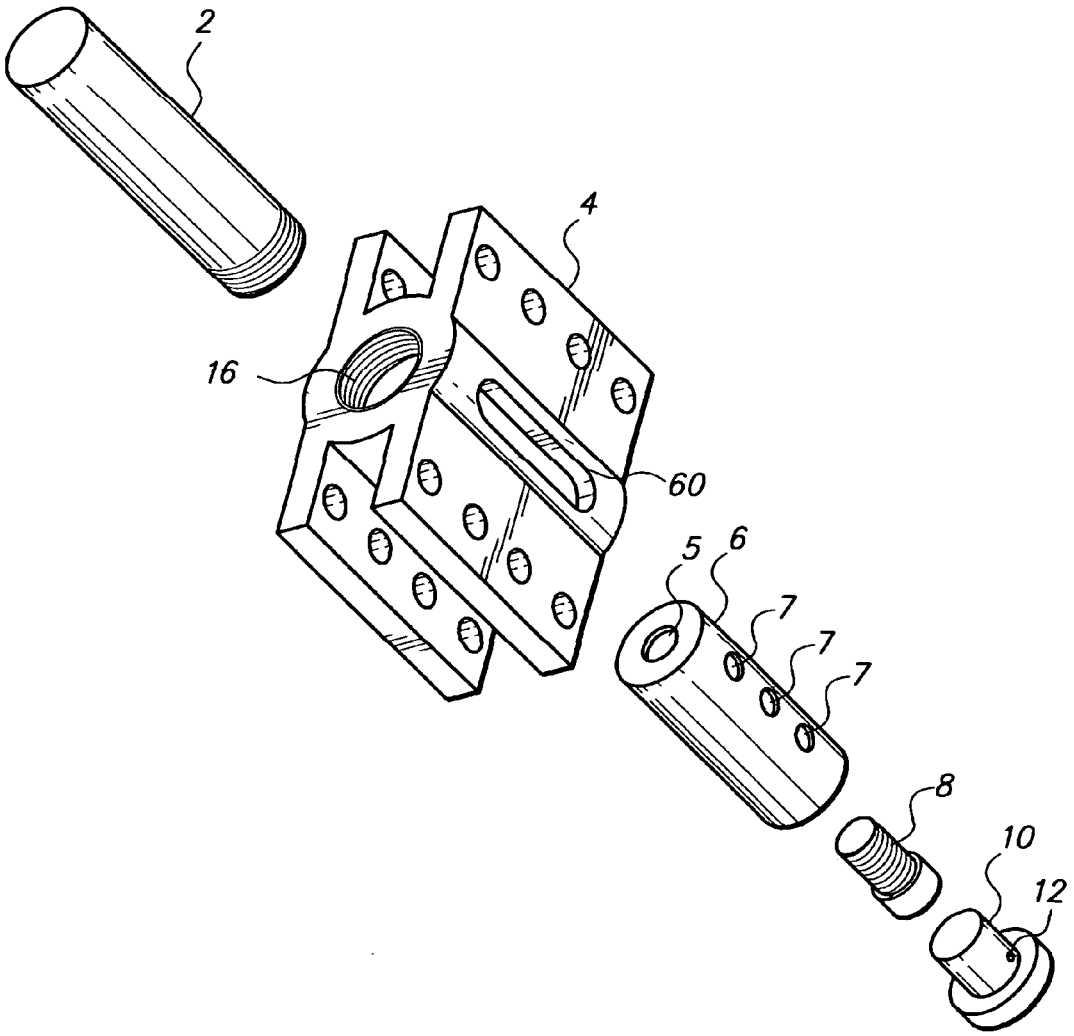
FIG. 1 shows an exploded view of a hydraulic cylinder, tool body, and ram extension in accordance with one embodiment.

FIG. 1 is an exploded view of a tool body constructed in accordance with one embodiment. The tool body 4 is an elongated tubular element of predetermined cross section. Possible cross sections include round, square, rectangular, and other shapes. Emanating from the exterior surface of said elongated tubular element is a plurality of fins in the direction of the longitudinal axis of the elongated tubular element. One end of the elongated tubular element is at least partially threaded internally 16 to receive the externally threaded attaching surface of the hydraulic cylinder 2. There is at least one elongated aperture 60 that communicates with the inner diameter and the exterior surface of tool body 4. A ram extension 6 of predetermined cross section is so proportioned as to be displaceable within the inner diameter of tool body 4, with the ram extension 6 accessible via the elongated aperture 60. One end of ram extension 6 has an aperture 5 through which the threaded portion of bolt 8 passes to couple ram extension 6 to the ram of hydraulic cylinder 2. Ram extension 6 has a plurality of apertures 7 radially disposed and whose axes are at right angles to the longitudinal axis of the ram extension. Nosepiece 10 is retained in the bore of ram extension 6 by spring plunger 12.

Figure 2:
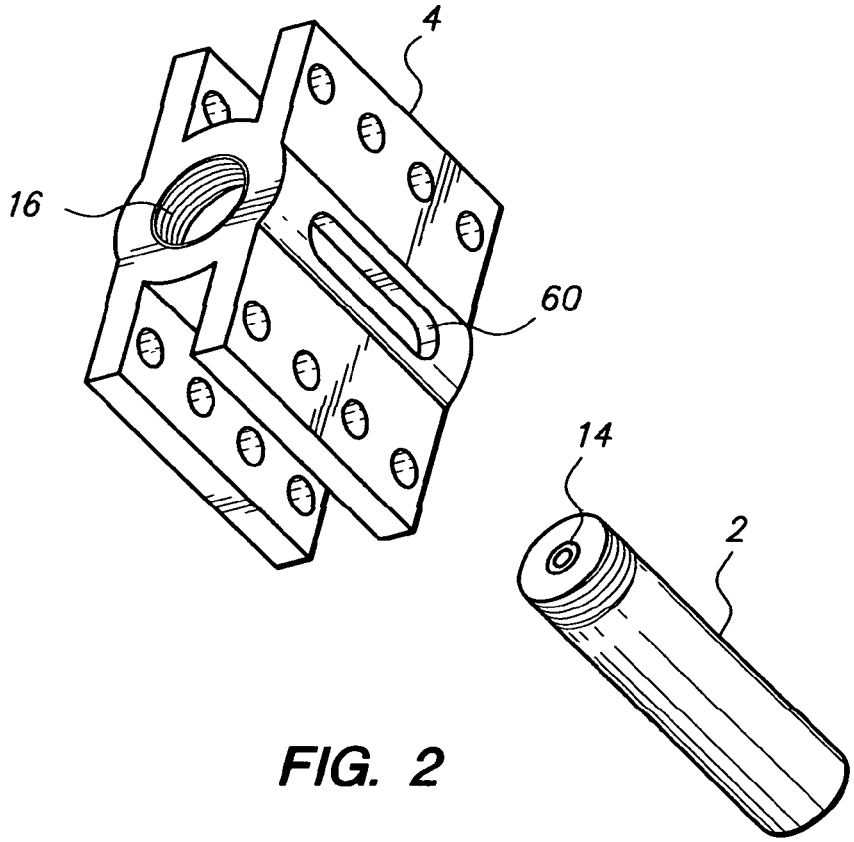
FIG. 2 shows an exploded view of the tool body and a hydraulic cylinder oriented in accordance with another embodiment.

FIG. 2 is an exploded view of tool body 4 and hydraulic cylinder 2 configured such that hydraulic cylinder 2 is disposed within the inner diameter of tool body 4 and threadably engaged with the internally threaded aperture 16 such that the ram 14 of hydraulic cylinder 2 is exposed on the surface of tool body 4.

Figure 3:
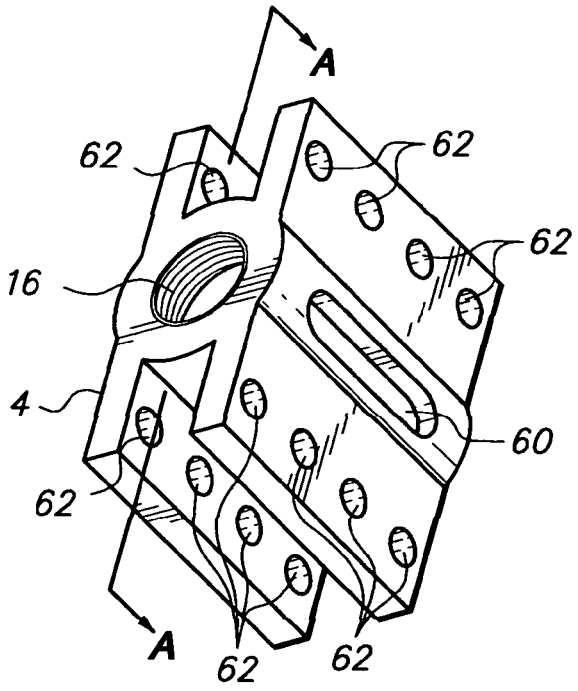
FIG. 3 shows a perspective view of the tool body.

FIG. 3 is an enlarged view of tool body 4 and showing a plurality of apertures 62 in the fins of tool body 4. Also shown are the elongated aperture 60 and the at least partially internally threaded inner diameter 16 of tool body 4. The apertures 62 are so arranged that members may be passed through the coaxially located apertures 62 in adjacent fins.

Figure 4:
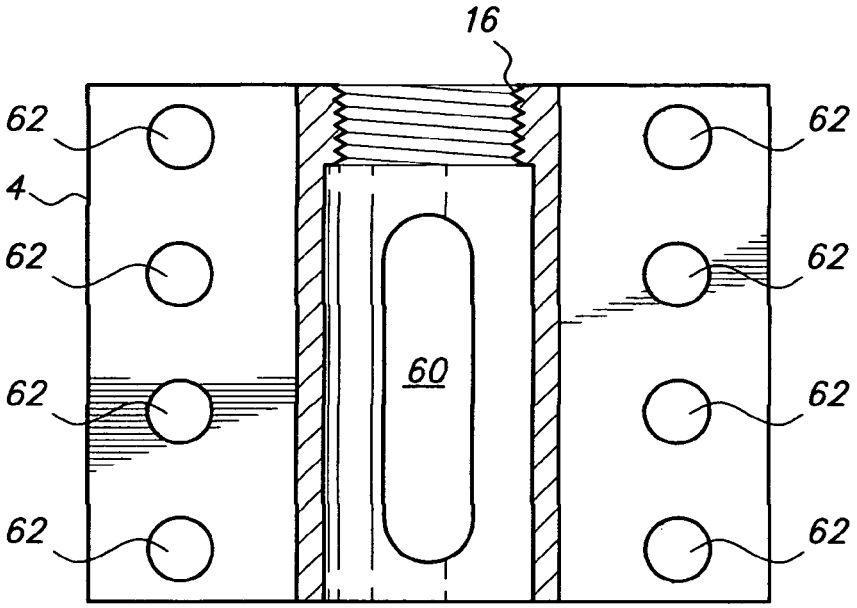
FIG. 4 shows a cross section of the tool body taken at section A-A of FIG. 3.

FIG. 4 is a cross section view of section A-A of FIG. 3 showing the at least partially threaded inner diameter 16 of tool body 4 along with the elongated aperture 60 and the plurality of apertures 62.

Figure 5:
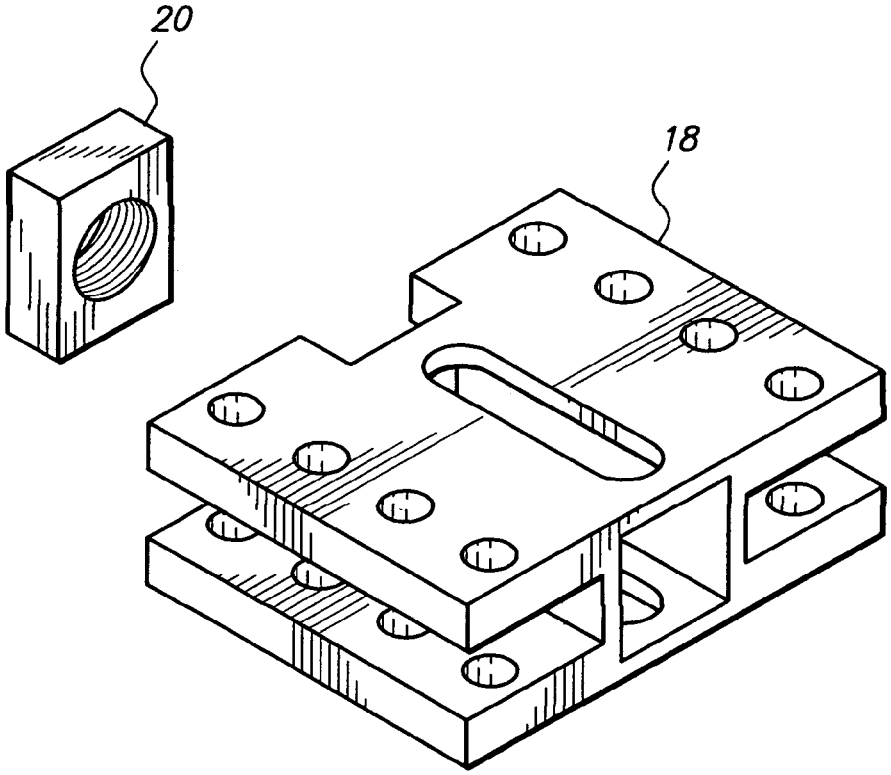
FIG. 5 shows an exploded view of an alternate embodiment of the tool body employing a tubular element of square cross section.

FIG. 5 is a perspective view of an alternative embodiment of a tool body 18 whose elongated tubular element is of square cross section, which necessitates the use of hydraulic cylinder adapter 20.

Figure 6:
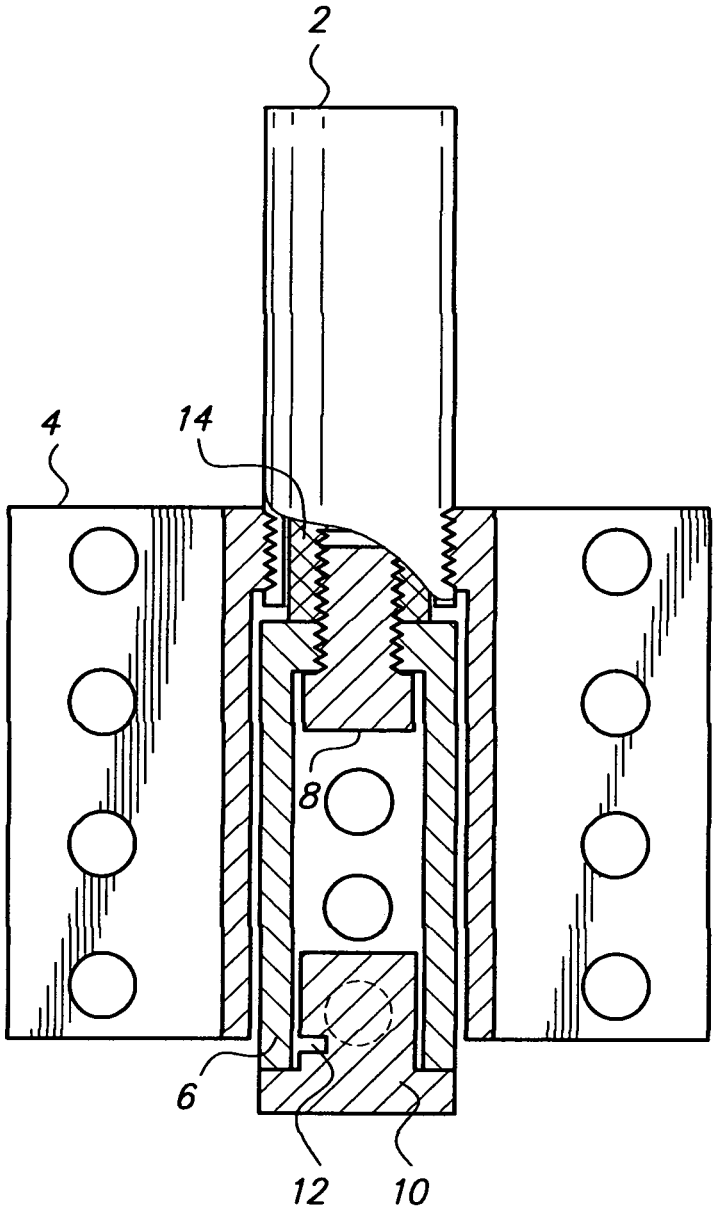
FIG. 6 shows a partial cutaway view of the assembled elements of the embodiment shown in FIG. 1 when the embodiment is in the retracted or inoperative position.

FIG. 6 is a sectional view in the non-operative position showing the hydraulic cylinder 2 attached to tool body 4 with the ram extension 6 connected to the ram 14 of hydraulic cylinder 2 by means of bolt 8. Nosepiece 10 is frictionally retained in the end of ram extension 6 by spring plunger 12.

Figure 7:
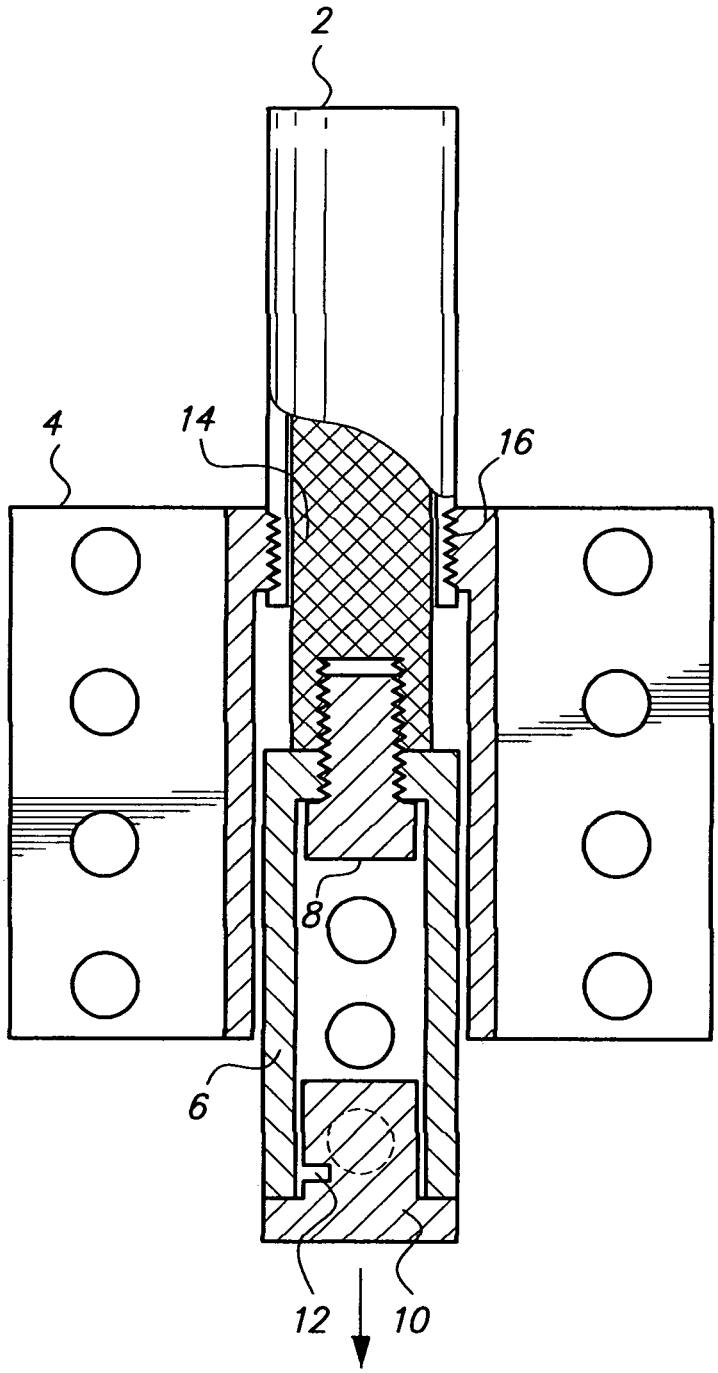
FIG. 7 shows a partial cutaway view of the assembled elements of the embodiment shown in FIG. 1 when the embodiment is in the extended or operative position.

FIG. 7 is a sectional view in the operative position showing the hydraulic cylinder 2 attached to tool body 4 with the ram extension 6 connected to the ram 14 of hydraulic cylinder 2 by means of bolt 8. Nosepiece 10 is frictionally retained in the end of ram extension 6 by spring plunger 12. The ram extension 6 and ram 14 are disposed in the direction of the arrow.

Figure 8:
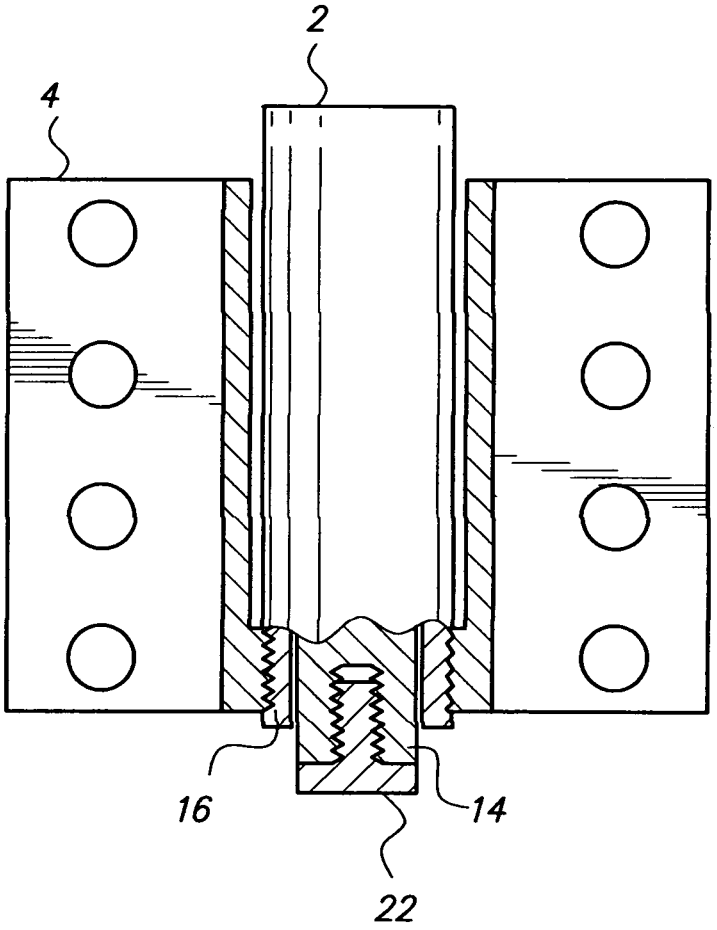
FIG. 8 shows an alternate embodiment with the hydraulic cylinder positioned within the tubular element of the tool body, when the embodiment is in the retracted or inoperative position.

FIG. 8 is a sectional view in the inoperative position showing the hydraulic cylinder 2 positioned within the inner diameter of the elongated tubular member of tool body 4 and threadably engaged with the at least partially internally threaded inner diameter 16.

Figure 9:
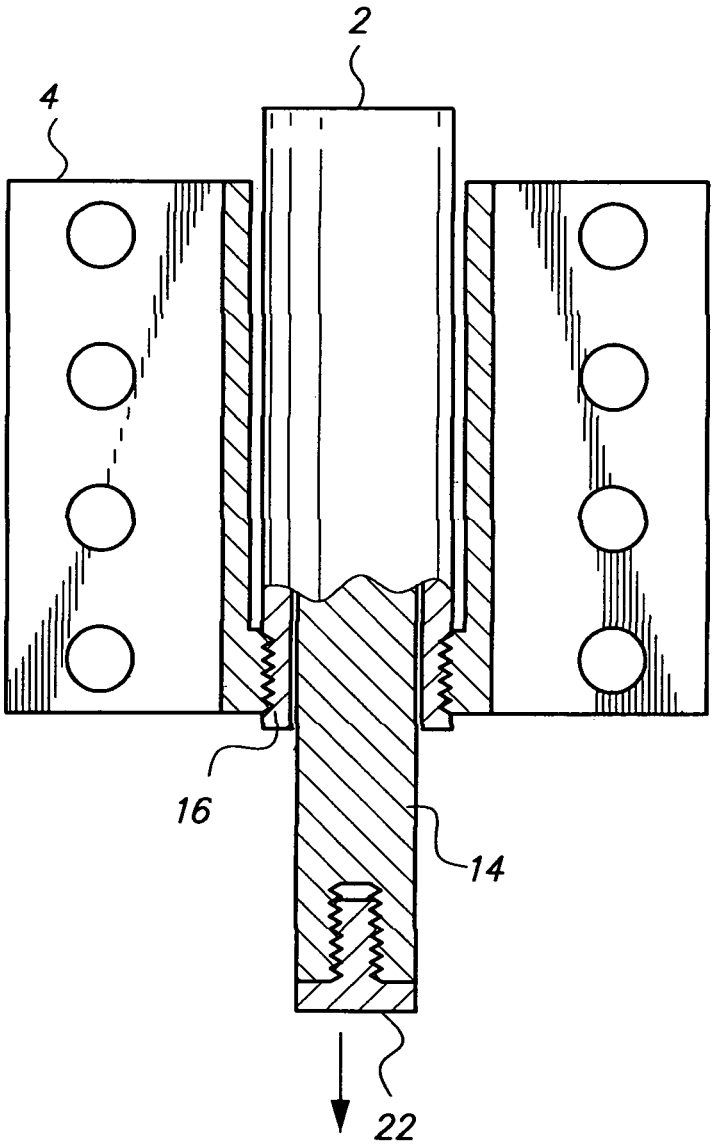
FIG. 9 shows the embodiment of FIG. 8 in the extended or operative position.

FIG. 9 is a sectional view in the operative position showing the hydraulic cylinder 2 positioned within the inner diameter of the elongated tubular member of tool body 4 and threadably engaged with the at least partially internally threaded inner diameter 16. In this view the ram 14 carrying nosepiece 22 is advanced in the direction of the arrow.

Figure 10:
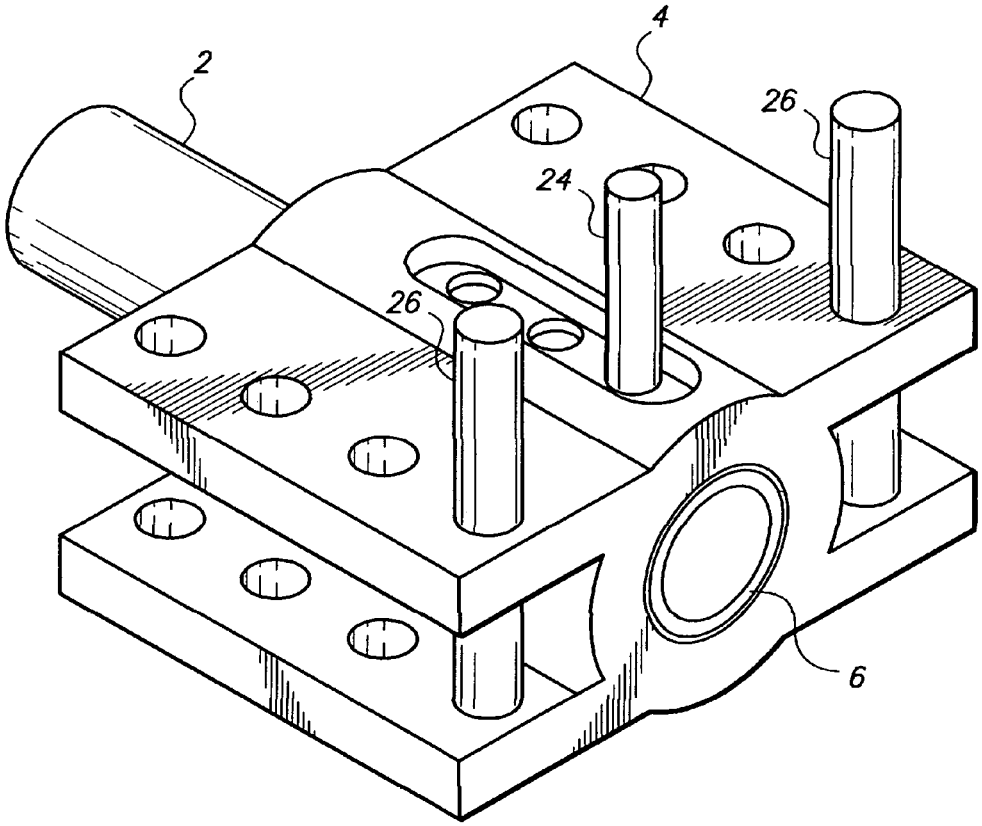
FIG. 10 shows a perspective view of the embodiment of FIG. 6 when configured to perform bending using the three pin method that is well known to the art.

FIG. 10 is a perspective view of the invention configured as an open side press using the tool body 4 as a press frame. Pin 24 is inserted into ram extension 6, which is connected to the ram of hydraulic cylinder 2. Pins 26 are inserted into apertures in the fins of tool body 4 and act as stationary supports for the workpiece and transfer reaction forces to the tool body 4. Hydraulic cylinder 2 when in the operative position advances ram extension 6 carrying pin 24 towards stationary pins 26, thus applying mechanical force to a workpiece positioned between pins 26 and pin 24.

Figure 11:
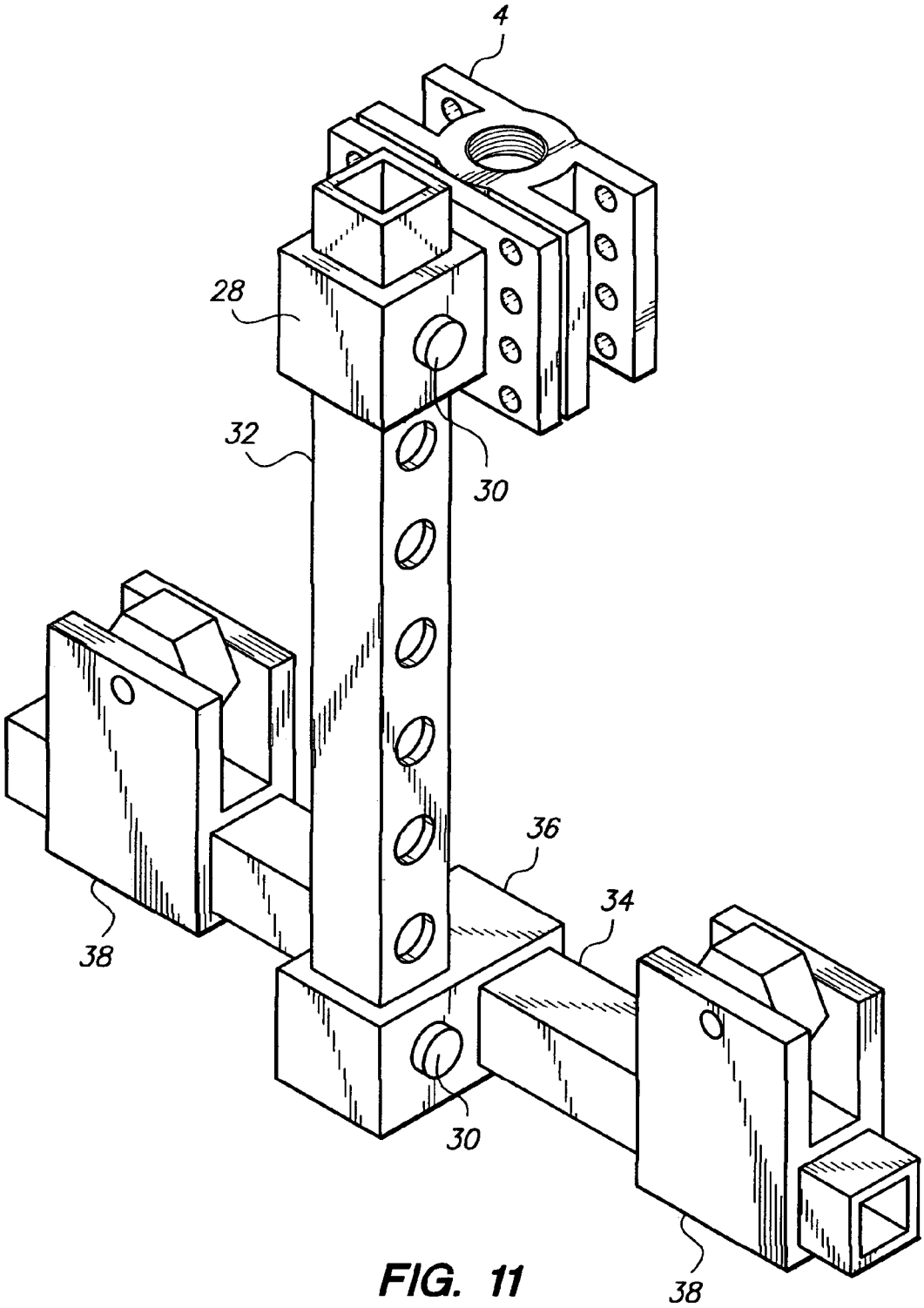
FIG. 11 shows a perspective view of the tool body attached to one form of C-frame press structure.

FIG. 11 is a perspective view of the invention configured as a C-frame press. tool body 4 is attached to a vertical column 32 by means of press head adapter 28, which is secured to column 32 by means of pin 30. Column 23 is connected to the base 34 by means of coupling 36 and pin 30. Base 34 carries a plurality of reaction blocks 38.

Figure 12:
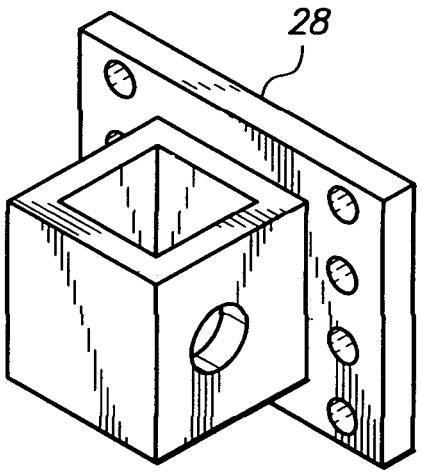
FIG. 12 shows a perspective view of an adapter to attach the tool body to the column of the C-frame press structure shown in FIG. 11.

FIG. 12 is a perspective view of tool body adapter 28.

Figure 13:
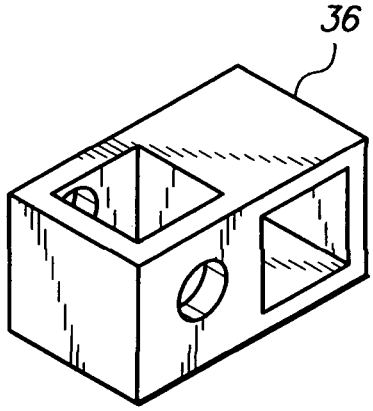
FIG. 13 shows a perspective view of an adapter to connect the column and horizontal base of the C-frame press structure shown in FIG. 11.

FIG. 13 is a perspective view of coupling 36.

Figure 14:
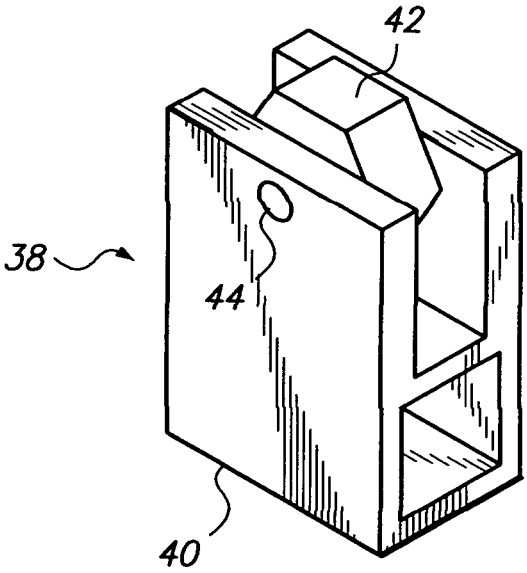
FIG. 14 shows a perspective view of a work support block of the C-frame press structure shown in FIG. 11.

FIG. 14 is a perspective view of reaction block 38 comprised of housing 40 that carries step block 42 on axle 44.

Figure 15:
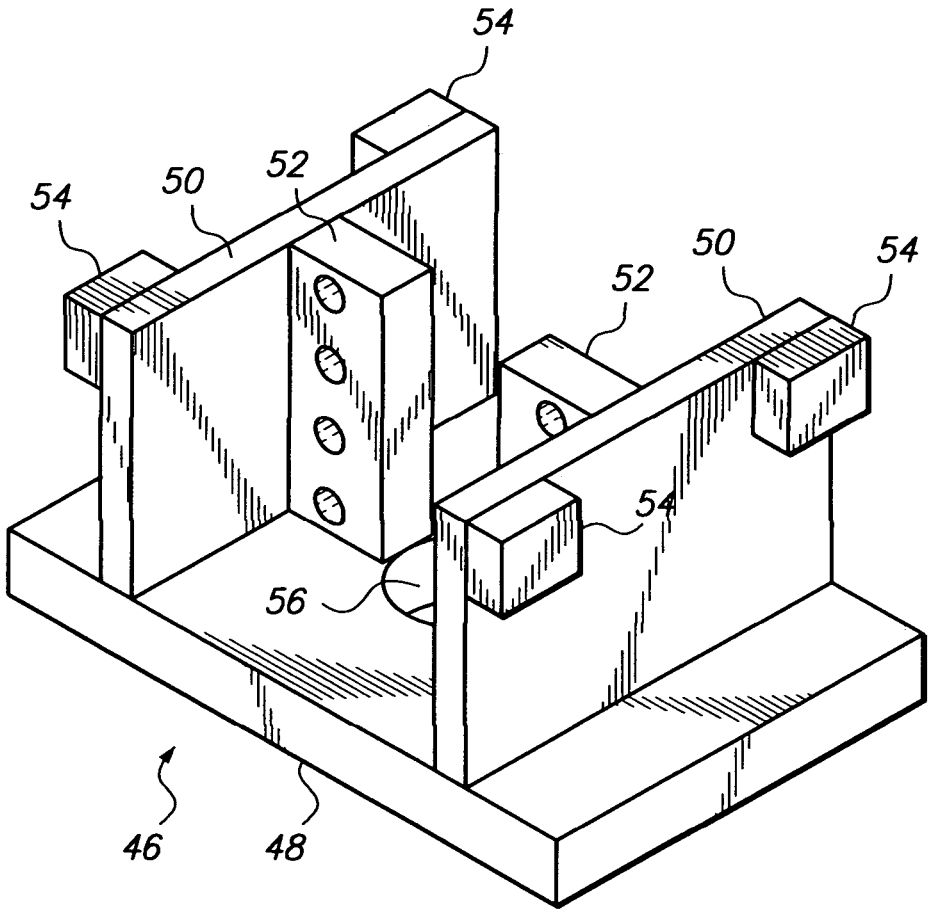
FIG. 15 shows a perspective view of one embodiment of an adapter to attach one embodiment of the tool to a conventional H-frame press frame (not shown).

FIG. 15 is a perspective view of an adapter 46 for a conventional H-frame press comprised of base plate 48 containing an aperture 56 and a plurality of side plates 50 to which are attached a plurality of mounting flanges 52 and blocks 54.

Figure 16:
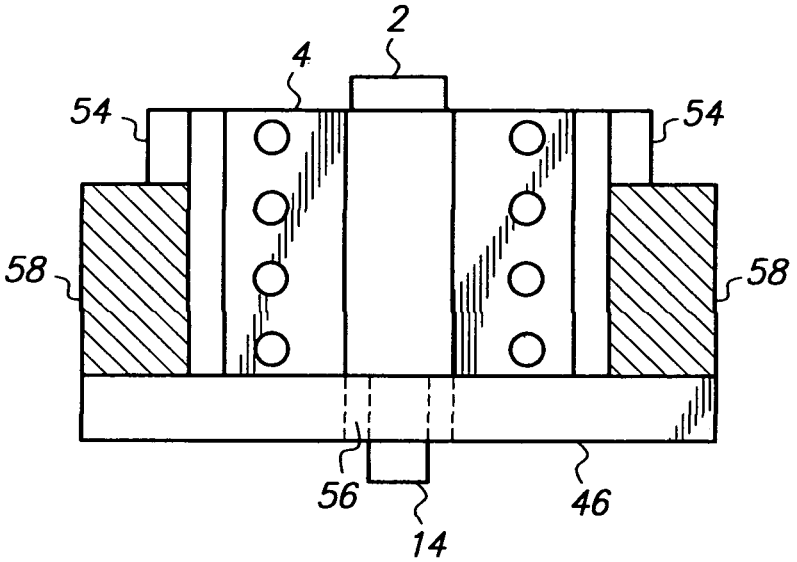
FIG. 16 is an elevation view of the adapter shown in FIG. 15.

FIG. 16 is an elevation view of the H-frame adapter 46 attached to H-frame members 58 and restrained against the force of gravity by blocks 54. Hydraulic cylinder 2 is threadably engaged with tool body 4, which is secured to H-frame adapter 46. Ram 14 of the hydraulic cylinder 2 extends through aperture 56.

Figure 17:
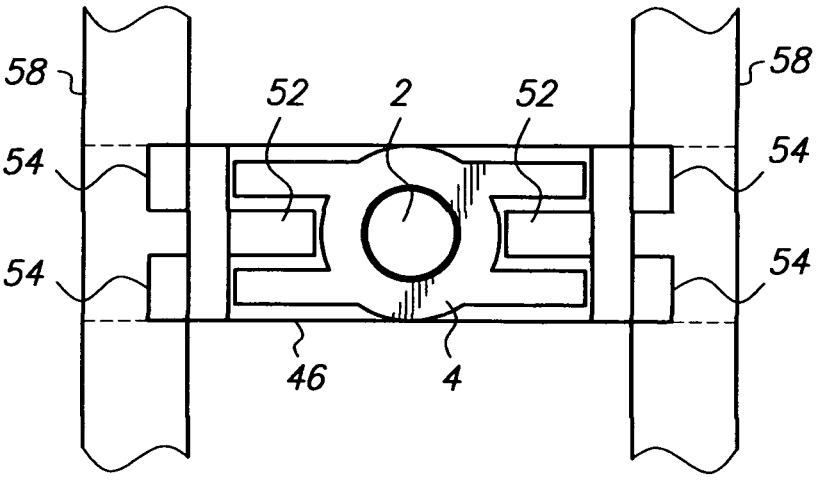
FIG. 17 is a plan view of the adapter shown in FIG. 15.

FIG. 17 is a plan view of H-frame adapter 46 showing tool body adapter 4 located between the mounting flanges 52.

FIGS. 18-20

Alternate Power Source

There are situations in which the risk of leaks of hydraulic oil is unacceptable and therefore a totally mechanical source of power for the pressing and bending operations is necessary. One embodiment provides for this by means of a mechanical ram apparatus that screws into the press head in place of the hydraulic cylinder. This has the advantage of allowing the same tool body to be used with either a hydraulic cylinder or a mechanical power source, as appropriate for the particular operation being performed.

Figure 18:
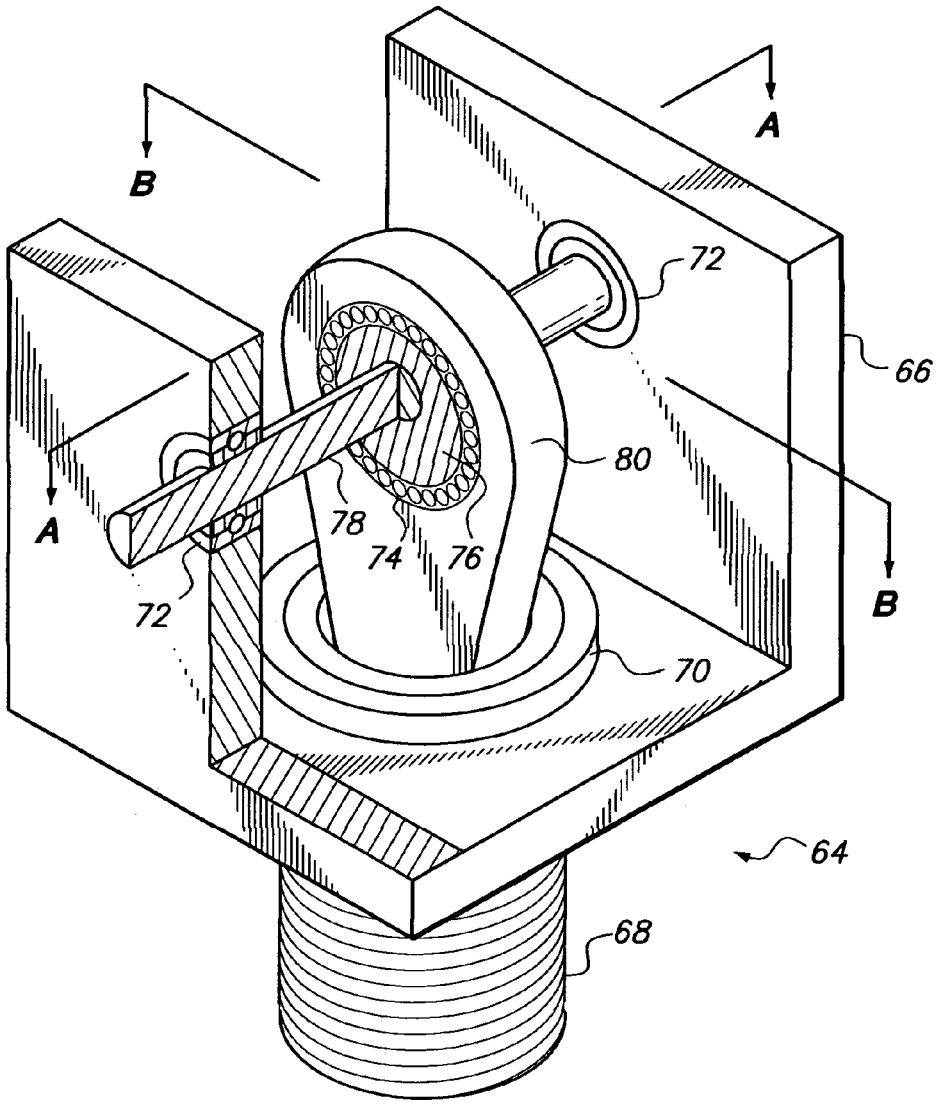
FIG. 18 shows a perspective and partial cutaway view of one embodiment of an alternative power source for one embodiment of the tool, attachable to the tool in the same manner as the hydraulic cylinder used in other embodiments.

FIG. 18 is a perspective sectional view of a mechanical ram 64 comprised of a housing 66 with an aperture in its base through which externally threaded sleeve 68 passes. Sleeve 68 is retained in housing 66 by retainer 70 and the sleeve is free to rotate about the longitudinal axis of the sleeve. Housing 66 has a plurality of bearings 72 through the inner diameters of which is passed a shaft 78 to which is affixed eccentric 76. One end of connecting rod 80 carries bearing 74 whose inner diameter is in contact with the periphery of eccentric 76 and the other end of said connecting rod is within the inner diameter of externally threaded sleeve 68. Rotation of the eccentric 76 by means of shaft 78 causes connecting rod 80 to reciprocate within the inner diameter of externally threaded sleeve 68.

Figure 19:
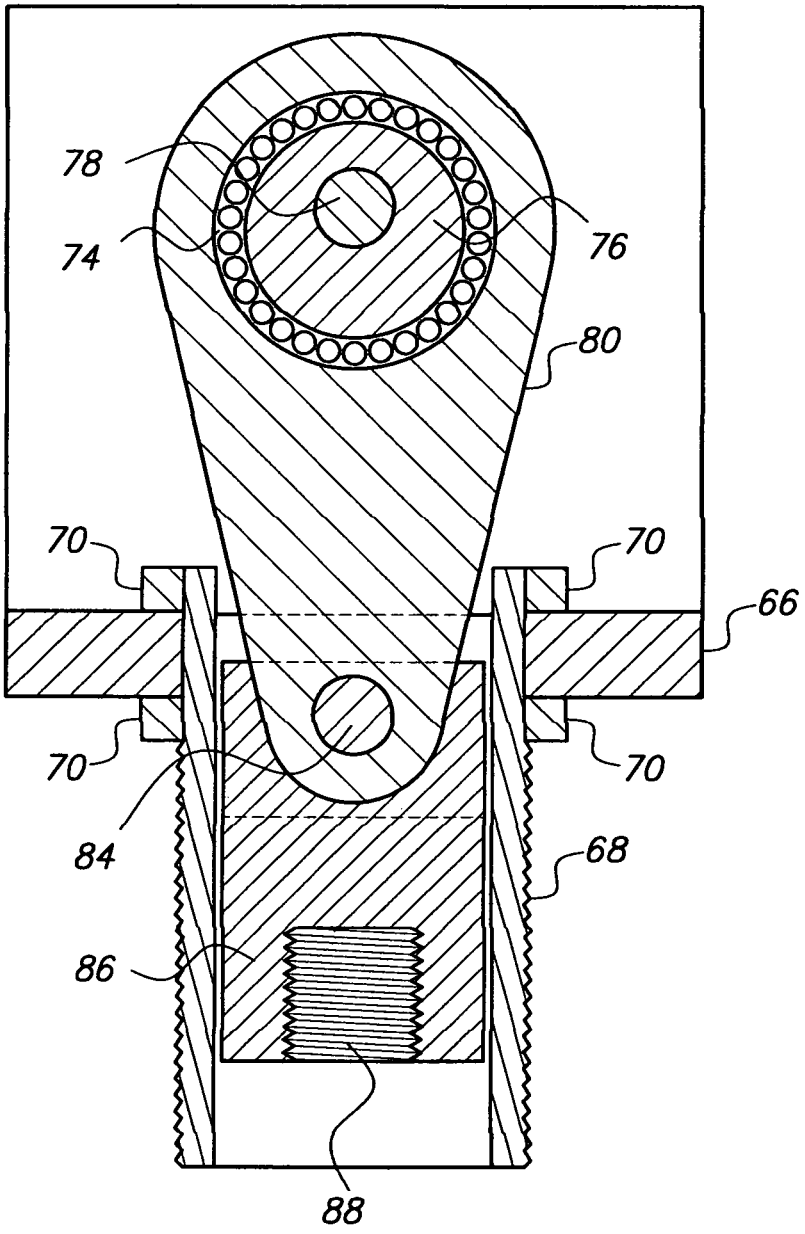
FIG. 19 shows a cross sectional view taken at section B-B of FIG. 18 of one embodiment of an alternate power source for the tool.

FIG. 19 is a sectional view of section B-B of FIG. 18. Housing 66 has an aperture in its base through which externally threaded sleeve 68 passes and is retained in the housing by retainers 70 thus allowing sleeve 68 to rotate about its longitudinal axis. One end of connecting rod 80 carries a bearing 74 whose inner diameter is in contact with eccentric 76 which is affixed to shaft 78. The other end of connecting rod 80 is rotatably coupled to crosshead 86 by means of pin 84. Rotation of shaft 78 and eccentric 76 imparts a reciprocating motion to crosshead 86 by means of connecting rod 80 and pin 84. Internal thread 88 is a means of connecting crosshead 86 to elements intended to receive the reciprocating motion of the crosshead.

Figure 20:
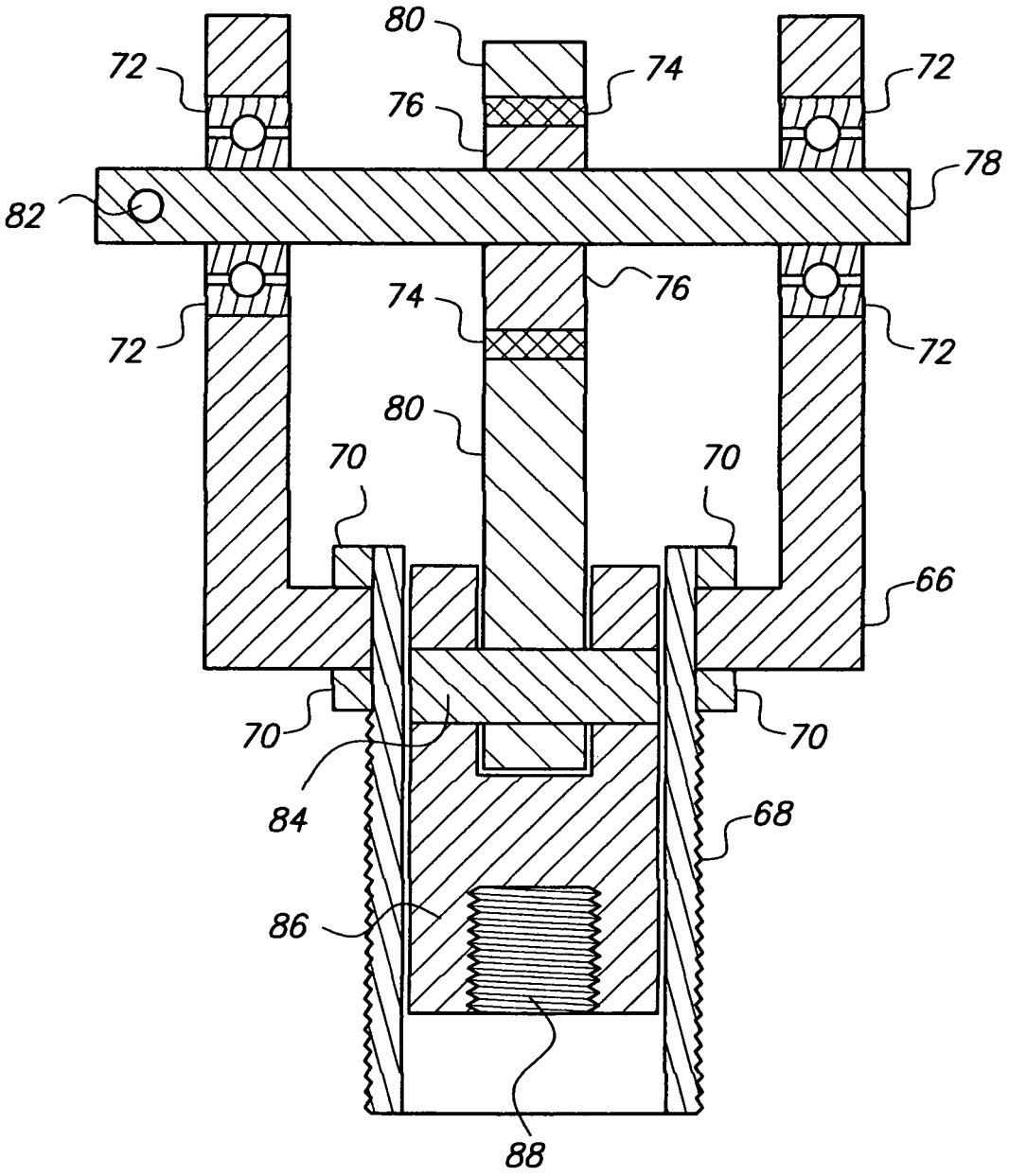
FIG. 20 shows a cross sectional view taken at section A-A of FIG. 18 of one embodiment of an alternate power source for the tool.

FIG. 20 is a sectional view of section A-A of FIG. 18. Housing 66 has an aperture in its base through which externally threaded sleeve 68 passes and is retained in the housing by retainers 70 thus allowing sleeve 68 to rotate about its longitudinal axis. Eccentric 76 is affixed to shaft 76, which passes through the inner diameters of bearings 72. One end of connecting rod 80 carries a bearing 74 whose inner diameter is in contact with eccentric 76 which is affixed to shaft 78. The other end of connecting rod 80 is rotatably coupled to crosshead 86 by means of pin 84. Rotation of shaft 78 and eccentric 76 imparts a reciprocating motion to crosshead 86 by means of connecting rod 80 and pin 84. Internal thread 88 is a means of connecting crosshead 86 to elements intended to receive the reciprocating motion of the crosshead. Aperture 82 is intended to receive a pin (not shown) used to secure an operating handle (not shown) to shaft 78 to impart rotation to the shaft.

Operation—

In operation the hydraulic cylinder 2; the mechanical ram 64, or another power source will be attached to the internal thread 16 of the tool body 4. In one embodiment a source of hydraulic pressure controlled by the operator will be connected to the hydraulic cylinder 2. When the mechanical ram 64 is used the operating force will be supplied by means of a handle (not shown), or other device manipulated by the operator.

One embodiment will most often be used in one or more of the configurations shown in FIGS. 10, 11 and 16. The open side configuration of FIG. 10 is particularly suited to hand held use because of its compact size. It is also particularly suited to bending elements of ornamental metal panels and scrollwork that is most effectively worked from the side of the work piece. It is also contemplated that the user will devise various nosepieces, pulling jaws, arms and other elements that will be attached to the apertures of the tool body 4 and the ram extension 6.

The operation in the configurations shown in FIGS. 6 and 8 is similar. The significant difference between them is the presence or non-presence of the ram extension 6. The configuration shown in FIG. 8 is suited to basic pressing operations where a simple nosepiece 22 will be used to apply force to the workpiece and where offset loads that would damage the ram 14 of the hydraulic cylinder 2. are not present. The configuration shown in FIG. 6 offers significant versatility and flexibility by using the ram extension 6 and the apertures thereof to attach different nosepieces 10 or other elements so as to best suit the operation being performed. The configuration of FIG. 6 is also particularly suited to conditions where side loading forces must be resisted.

The configurations shown in FIGS. 6 and 8 may be used in both the C-frame press of FIG. 11 and a conventional H-frame press (not shown), the choice being influenced by the nature of the workpiece and the operation to be performed.

When using the mechanical ram 64 as shown in FIGS. 18, 19, 20, the internal thread 88 of crosshead 86 will be coupled to a ram extension or other element. Rotation of the threaded sleeve 68 is used to accomplish range adjustment of crosshead travel in between the discrete positions afforded by elements inserted through the apertures of the tool body 4 or when the press head body is attached to external press frames.

FIG. 5

Alternate Embodiment

An alternate embodiment of the tool having a tubular element of square cross section is shown in FIG. 5, comprising a tool body 18 and an adapter block 20. It is contemplated that there may be situations where the square cross section will be advantageous. Operation of the alternate embodiment is the same as the first embodiment.

CONCLUSIONS, RAMIFICATIONS, AND SCOPE

Thus the reader will see that at least one embodiment of the combination press and puller tool provides a versatile tool that can be configured for either hand held use or mounted to any type of press structure. Any type of work engaging arms or appliances may be readily attached to the tool, and it is particularly easy for users to attach work engaging appliances of their own design to the tool.

While my above description contains many specificities, these should not be construed as limitations on the scope, but rather as an exemplification of several embodiments thereof. Many other variations are possible. For example, the cross section of the tubular element can be rectangular, and can have an externally threaded portion with or without the internally threaded portion.

Accordingly, the scope should be determined not by the embodiments illustrated, but by the appended claims and their legal equivalents.

I claim:

1. A multipurpose tool for applying pushing, pulling and bending forces to a workpiece, the multipurpose tool comprising:

an elongated tubular element open at both ends with an interior surface of at least one end being at least partially threaded;

said elongated tubular element having a plurality of elongated apertures displaced radially about a central axis of said elongated tubular element with a long axis of said elongated apertures parallel to the central axis of said elongated tubular element, said elongated apertures communicating between the interior surface and an exterior surface of the elongated tubular element;

a plurality of elongated fins displaced radially about the exterior surface of said elongated tubular element, with a long axis of said fins parallel to the central axis of said elongated tubular element;

said elongated fins having a plurality of apertures communicating between a first surface and a second surface of each fin, the axis of said apertures being at approximately 90 degrees to the long axis of said fins;

a hydraulic cylinder device is located coaxially with a bore of the tubular element and threadably engaged with an internal thread of a bore with an extensible ram of the hydraulic cylinder is displaceable within the bore.

2. The multipurpose tool of claim 1, further including a ram extension, said ram extension is located coaxially within a bore of the elongated tubular element and threadably engaged with a ram of the hydraulic cylinder.

3. A multipurpose tool for applying pushing, pulling and bending forces to a workpiece, the multipurpose tool comprising:

an elongated tubular element open at both ends with an interior surface of at least one end being at least partially threaded;

said elongated tubular element having a plurality of elongated apertures displaced radially about a central axis of said elongated tubular element with a long axis of said elongated apertures parallel to the central axis of said elongated tubular element, said elongated apertures communicating between the interior surface and an exterior surface of the elongated tubular element;

a plurality of elongated fins displaced radially about the exterior surface of said elongated tubular element, with a long axis of said fins parallel to the central axis of said elongated tubular element;

said elongated fins having a plurality of apertures communicating between a first surface and a second surface of each fin, the axis of said apertures being at approximately 90 degrees to the long axis of said fins;

a structure comprising a crankshaft carrying an eccentric, the eccentric driving a connecting rod, the connecting rod pivotably attached to a ram within a bore of the tubular element, with the structure having a threaded sleeve protruding from a base of the structure and threadedly engaged with an internal thread of a bore of the tubular element.

4. The multipurpose tool of claim 3, further including a ram extension slidable within a bore of the tubular element and attached to the ram.

* * * * *